United States Patent [19]

Tesack et al.

[11] 4,337,917

[45] Jul. 6, 1982

[54] GAS PUMP HOLDER

[76] Inventors: Gerald Tesack, c/o George Spector, 3615 Woolworth Bldg., 233 Broadway; George Spector, 3615 Woolworth Bldg., 233 Broadway, both of New York, N.Y. 10007

[21] Appl. No.: 166,036

[22] Filed: Jul. 7, 1980

[51] Int. Cl.[3] ..... G05G 5/06

[52] U.S. Cl. ..... 251/90; 74/525; 74/526; 141/392; 248/354 R; 251/114

[58] Field of Search ..... 141/1, 392; 74/520, 74/524, 525, 526; 251/90, 111, 113, 114, 84; 248/351, 354 R

[56] References Cited

U.S. PATENT DOCUMENTS

| | | | |
|---|---|---|---|
| D. 254,050 | 1/1980 | Fitzgerald | 141/392 |
| 2,704,199 | 3/1955 | Olson | 74/520 |
| 4,175,595 | 11/1979 | Noe | 251/90 |
| 4,210,181 | 7/1980 | Clevenger | 74/526 |
| 4,216,807 | 8/1980 | Diamond | 141/392 |
| 4,245,682 | 1/1981 | Agnew, Sr. | 141/392 |

*Primary Examiner*—George L. Walton

[57] ABSTRACT

A device that fits on a gasoline pump nozzle handle for holding the valve open, instead the need of continuously squeezing the handle in a hand; the device, in one design, including a collapsible brace for pressing against the handle.

3 Claims, 5 Drawing Figures

GAS PUMP HOLDER

This invention relates generally to automobile service station accessories. More specifically it relates of gasoline pump nozzle accessories.

It is well known that at these times, many of the automobile service stations are equipped with self-service gasoline pumps where the motorist fills his vehicle gasoline tank himself, instead of the service station attendent doing it for him. Many of the pump nozzles require that the handle be continually squeezed so as to keep the gasoline flowing. This is particularly undesirable on cold or rainy days when the motorist is accordingly obliged to stand a long while outside in the cold or rain, as he is not dressed for this while he is riding comfortably inside the closed vehicle interior. This situation is therefore in need of improvement.

Accordingly a principle object of the present invention is to provide a holder which will retain a gas pump nozzle open without the need of continually depressing the nozzle handle, so that once it is set in an open, operative position, a motorist can leave the same and seek shelter from weather inside his vehicle while his gasoline tank is being filled.

Another object is to provide a gasoline pump nozzle handle holder accordingly when installed at a full service pump allows the station attendent to wait upon more than one customer at a time, or which at a self-service pump allows the motorist to check his oil meantime or attend to other chores.

Figure 1:
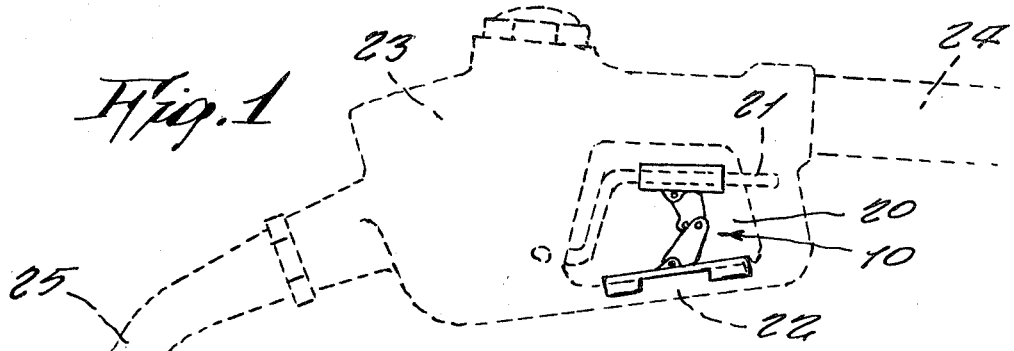
FIG. 1 is a side view of a gas pump nozzle, and showing one design of the invention which snaps into operative position.
Figure 2:
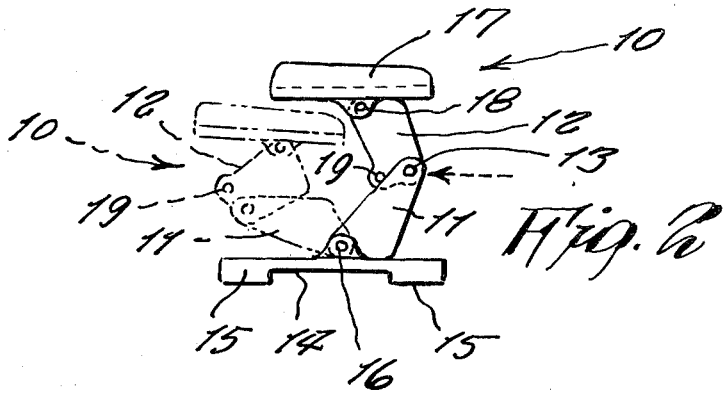
FIG. 2 is an enlarged side view of the invention, and showing how it snaps into operative or inoperative position by simply pushing against a collapsible stem thereof.

Referring now to the drawing in greater detail, and more particularly to FIGS. 1 and 2 thereof, at this time, the reference numeral 10 represents a gas pump holder, according to the present invention, wherein the same comprises a pair of levers 11 and 12 pivotably attached together by means of a transverse pivot pin or rivet 13 therethrough.

A flat foot 14 provided with downward toes 15 at each corner of the foot, a pivoted on an outward end of the lever 11 by means of a pivot pin 16, while a channel-shaped plate 17 is pivotally attached on an outward end of the lever 12 by means of a pivot pin 18.

A stop 19 affixed on the lever 12 alots against an edge of the lever 11 and serves to limit the pivotal travel of the levers in one direction.

In operative use, the holder 10 is fitted inside a space 20 formed between the pivotable handle 21 and a stationary guard 22 of a nozzle base 23 fitted on an end of a hose 24 attached to a gasoline pump of a service station. A nozzle 25 is fitted on the base, for insertion in a vehicle gasoline tank filler pipe. A valve (not shown) is contained in the base 23 and is operated by the handle 21 for allowing flow of gasoline from the pump to the vehicle gasoline tank.

The holder is installed in the space 20 by means of the foot resting against the guard while the plate 17 rests against the handle 21.

When the valve is in a shut off position, the handle 21 is pivoted in a position closer to the guard so that in this position, the holder 10 is in a collapsed position as shown by the phantom lines in FIG. 2.

When the nozzle is intended to feed fuel through the valve, the handle 21 is then pivoted away from the guard and is retained in this position by means of the holder being extended pivotally into the position shown by the solid lines in FIG. 2.

When the vehicle tank becomes filled, the fuel level trips the valve mechanism so as to automatically shut off the fuel flow. The nozzle is then removed from the tank filler opening and is hung up on a fitting provided therefor ON the pump, and when the handle is pivoted to its originally shut off position by again collapsing the holder.

Figure 3:
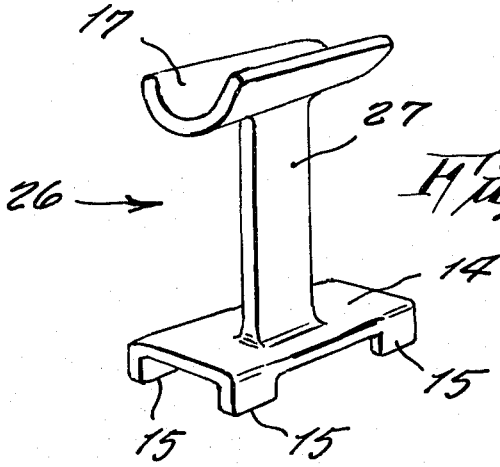
FIG. 3 is a perspective view of another design of the invention in which the stem is rigid.
Figure 4:
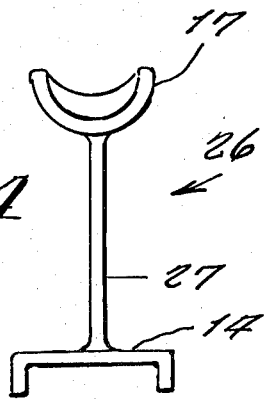
FIG. 4 is a front view thereof.
Figure 5:
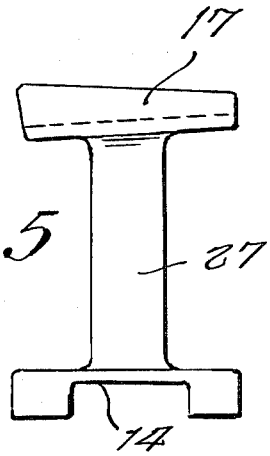
FIG. 5 is a side view thereof.

In a modified design of the invention, shown in FIGS. 3, 4 and 5, a holder 26 is generally a same as holder 10 except that it is of rigid type instead of being collapsible. Thus, instead of the pivotable levers 11 and 12, a single flat bar 27 is affixed between the foot 14 and the channel-shaped plate 17. In this design, the holder 26 is installed on the nozzle base only at a time of use, and is removed therefrom when the gas pumping operation is ended. This differs from the holder 10 which may be permanently retained on the nozzle base.

What is claimed as new, is:

1. A gas pump holder, comprising in combination, a device insertable between a pivotable handle and a stationary guard of a fuel pump nozzle base, said holder including a foot at one end for resting against said guard, and a channel-shaped plate at its other end for supporting said handle, and an adjustable pivot means between said foot and plate, whereby said means is pivotable from a position maintaining said handle in operation to a closed position permitting said handle to remain in inoperative position wherein said pivot means comprises a pair of levers pivotally attached together, and pivotally attached to said foot and said plate, including a stop on one of said levers adapted to engage the other of said levers to maintain a fixed position of said levers corresponding to the first said position.

2. The combination of claim 1 wherein said stop restricts pivotal movement of said levers in a rearward direction but does not restrict pivotal motion in a forward direction.

3. The combination of claim 1 wherein said stop comprises a transverse projection from one of said levers disposed to engage a forward edge of the other lever when said levers are in the first said position.

* * * * *